US006039295A

United States Patent [19]

de Beijer

[11] Patent Number: 6,039,295

[45] Date of Patent: Mar. 21, 2000

[54] MOUNTING SYSTEM

[75] Inventor: Justinus Lambertus Theodurus de Beijer, Maarheeze, Netherlands

[73] Assignee: Hunter Douglas International N.V., Netherlands Antilles

[21] Appl. No.: 09/027,119

[22] Filed: Feb. 17, 1998

[30] Foreign Application Priority Data

Feb. 19, 1997 [EP] European Pat. Off. ..... 97200473
Jul. 14, 1997 [EP] European Pat. Off. ..... 97305177

[51] Int. Cl.[7] ..... E06B 9/323

[52] U.S. Cl. ..... 248/262; 160/178.1; 160/902; 248/265

[58] Field of Search ..... 248/251, 261, 248/262, 254, 292.14, 299.1, 300, 265; 160/178.1, 902

[56] References Cited

U.S. PATENT DOCUMENTS

| | | | |
|---|---|---|---|
| 1,338,781 | 5/1920 | Levy | 248/299.1 |
| 1,965,668 | 7/1934 | Ringwald | 248/299.1 X |
| 2,896,893 | 7/1959 | Oliver | 160/178.1 X |
| 5,012,850 | 5/1991 | Schrader | 160/902 X |
| 5,131,616 | 7/1992 | Biba | 160/902 X |
| 5,188,162 | 2/1993 | Simon et al. | 160/902 X |
| 5,322,255 | 6/1994 | Garrett | 248/299.1 |
| 5,529,273 | 6/1996 | Benthin | 248/262 X |
| 5,655,590 | 8/1997 | Bryant | 160/178.1 X |
| 5,664,752 | 9/1997 | Matthiessen et al. | 248/299.1 |

FOREIGN PATENT DOCUMENTS 2267526 11/1995 United Kingdom .

*Primary Examiner*—Derek J. Berger
*Attorney, Agent, or Firm*—Dorsey & Whitney LLP

[57] ABSTRACT

A bracket for mounting a head rail or a bottom rail of a window covering product to a fixation surface includes a main body portion with a mounting aperture and opposed edges adapted to engage the head or bottom rail. The main body portion of the bracket is mounted to the fixation surface via the mounting aperture either by directly passing a mounting screw or the like through the mounting aperture and into the fixation surface, or by affixing the main body portion at its mounting aperture to a support member that is in turn affixed to the fixation surface. The mounting aperture is associated with a convex curved surface of either the main body portion or the support member. If the main body portion has the convex curved surface, the mounting aperture can be a circumferentially elongate slot in the convex curved surface of the main body portion. If the support member has the convex curved surface, an elongate slot is formed in the convex curved surface of the support member, and a bolt passes through the mounting aperture in the main body portion and through the elongate slot in the supporting member and engages a nut located within the support member.

20 Claims, 3 Drawing Sheets

MOUNTING SYSTEM

This invention relates to a mounting system for a window covering product, such as a blind or shade arrangement, particularly to affix such a product to a ceiling or wall or to an architectural opening, such as a door or window frame.

One form of mounting system includes a mounting bracket as disclosed in GB-B-2,267,526. The bracket comprises a main body portion with a mounting aperture extending through it, a first inturned flange on one edge of the main body portion, and a second inturned flange on the opposite edge of the main body portion. The inturned flanges can be attached to a rail of a window covering product, and a fixing means, such as a mounting screw or nail, can pass through the mounting aperture to affix the bracket to a ceiling, wall or door or window frame.

After this mounting bracket has been affixed to, or in, a building structure, such as a ceiling or wall or an architectural opening, with a fixing means, such as an ordinary screw, inserted through the mounting aperture into the building structure, the rail, which is usually part of a window covering product, could be affixed to the mounting bracket to support blinds or shades or even curtains. Usually, two or more brackets were affixed to retain properly the rail and with it the window covering product.

To achieve a desired orientation and proper operation of the window covering product, the building structure preferably had to have a fixation surface perpendicular to the desired orientation of the window covering product and be capable of accommodating fixation of the main body of the mounting bracket. If the building structure had a sloping fixation surface, such as for example exists with skylight frames, one could have provided one or more wedges between the fixation surface and the main body portion of the bracket, to provide the desired orientation for the window covering product.

A disadvantage of the known bracket has been that the fixation surface of the building structure has preferably had to be perpendicular to the desired orientation of the window covering product, to enable uncomplicated fixation of the mounting bracket.

According to the present invention there is provided a mounting bracket for mounting the headrail or bottom rail of a window covering product to a fixation surface, said bracket comprising a body portion and a mounting aperture in said body portion, opposed edges of said body portion being adapted to engage said rail, fixing means engaged in said mounting aperture and adapted to mount the bracket on a building structure, characterised in that said mounting aperture is in or adjacent to a convex curved surface of either said body portion or of said fixing means, thereby enabling said body portion and the rail supported thereby to be adjusted in position and at an angle determined by the position of said fixing means or body portion, respectively relative to said curved surface.

The invention also contemplates a mounting bracket for affixing the headrail or bottom rail of a window covering product to a fixation surface of a building structure, wherein the bracket comprises: a main body portion having a first mounting aperture therein and opposite edges of the main body portion are adapted to engage the rail; and fixing means connected to the first mounting aperture for affixing the bracket to the fixation surface of the building structure, characterized by:

a convex curved surface on either the main body portion or the fixing means, containing a circumferentially elongate slot in communication with the first mounting aperture, thereby enabling the main body portion and the rail supported thereby to be positioned at an angle, relative to the fixation surface, determined by the position of respectively either the fixing means or the main body portion circumferentially about the convex curved surface.

Such a bracket allows easy fixation of a rail of a window covering product to a sloping fixation surface of a building structure.

In accordance with one aspect of this invention: the convex curved surface, containing the elongate slot, is provided on the main body portion of the bracket; the first mounting aperture is in the elongate slot; the fixing means extends through the elongate slot and engages the fixation surface, so that the main body portion is convex relative to the fixation surface; and preferably, the elongate slot extends transversely to the opposite edges of the main body portion (which engage the rail of the window covering product). Advantageously, the main body portion of this bracket is formed of arcuately curved sheet material whereby one face of the main body portion is its convex curved surface. Such a bracket can be easily adjusted to a desired orientation relative to a sloping fixation surface of a building structure.

In accordance with another aspect of the bracket of the invention, the fixing means comprises:

a hollow elongated support member having, on one circumferential side, the convex curved surface and the elongate slot adjacent to the first mounting aperture of the main body portion;

first mounting means, on a substantially opposite circumferential side of the support member, to affix the support member to a sloping fixation surface of a building structure, so that the convex curved surface is concave relative to the fixation surface; and second mounting means, passing through the mounting aperture in the main body portion and through the elongate slot in the support member, to affix the main body portion to the support member, preferably with the opposite edges of the main body portion being transverse to the elongate slot.

Advantageously, the support member is tubular, and the second mounting means comprises a second mounting aperture for the passage of a conventional mounting screw. Advantageously, the circumferentially elongate slot in the support member is also enlarged, opposite the second mounting aperture, so that a screw driver can readily access the mounting screw in the second mounting aperture.

In accordance with the invention, the main body portion is also advantageously made of a resilient material and one edge is provided with an outwardly extending release member, enabling the main body portion to be flexed to disengage the one edge from the rail of the window covering product.

Further aspects of the invention will be apparent from the detailed description below of particular embodiments and the drawings thereof, in which.

In the Figures and the following description, corresponding parts are referred to by similar reference signs which differ by an "a" in FIG. 1 from those in FIGS. 2–4 and which differ by "100" in FIGS. 5–7 from those in FIGS. 2–4.

Figure 1:
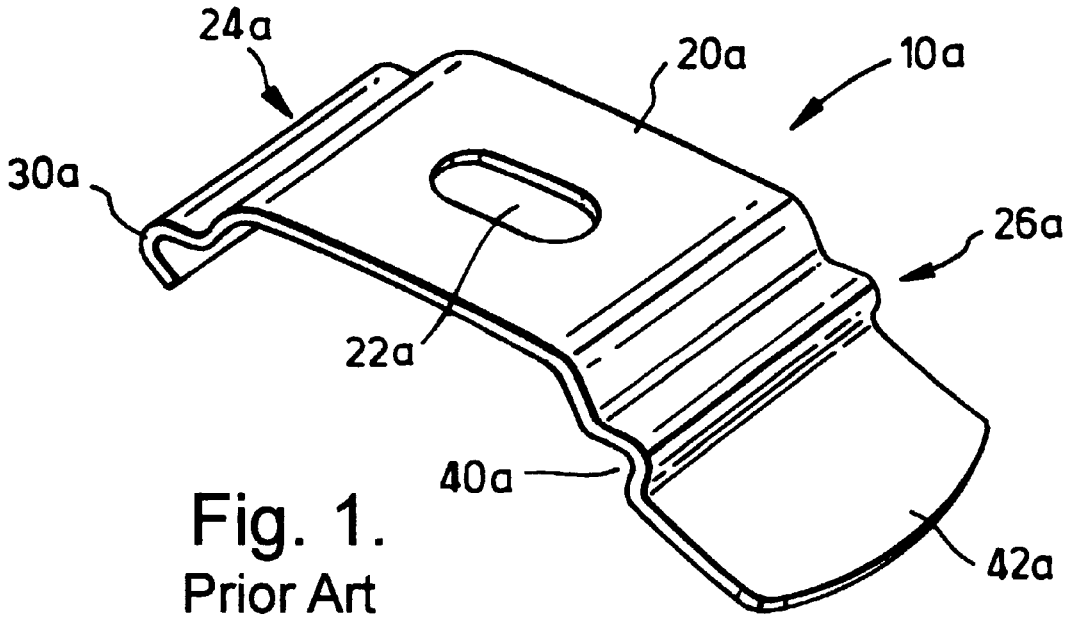
Fig. 1. Prior Art
FIG. 1 is an isometric view of a mounting bracket known from the prior art.

FIG. 1 shows a mounting bracket 10*a,* known from the prior art. The bracket 10*a* has a substantially flat, main or central body portion 20*a,* having a mounting aperture 22*a* extending through it. A first edge 24*a* and a second edge 26*a,* on opposite sides of the main body portion 20*a,* have respectively a first inturned flange 30*a* and a second inturned flange 40*a*. The mounting aperture 22*a* extends transversely to the edges 24*a* and 26*a* and can accommodate a fixing means, such as a conventional mounting screw, to affix the main body portion 20*a* to a fixation surface on a is building structure, such as a ceiling or a wall or an architectural opening such as a door or window frame. The inturned flanges 30*a* and 40*a* can be used to affix a rail (e.g., a head rail of a window covering product) to the bracket 10*a,* with the flanges extending in the same direction as the rail.

When the bracket 10*a* is made of resilient material, the second inturned flange 40*a* is provided with an outturned member 42*a*. Such resilient material allows the rail to be clipped or slid onto the inturned flanges 30*a* and 40*a* of the bracket 10*a,* so that the outturned member 42*a* can thereafter be used to facilitate the separation of the second inturned flange 40*a* from the rail.

Heretofore, in order to obtain a desired orientation and proper operation of a window covering product, a building structure preferably had to have a fixation surface perpendicular to the desired orientation of the window covering product and be capable of accommodating fixation of the main body portion 20*a* of the known mounting bracket 10*a*. If the building structure had a sloping surface, as for example existed with skylight frames, one might have to apply one or more wedges between the main body portion 20*a* of the bracket and the fixation surface to provide the desired orientation to the window covering product, which would require a complex and complicated installation.

Figure 2:
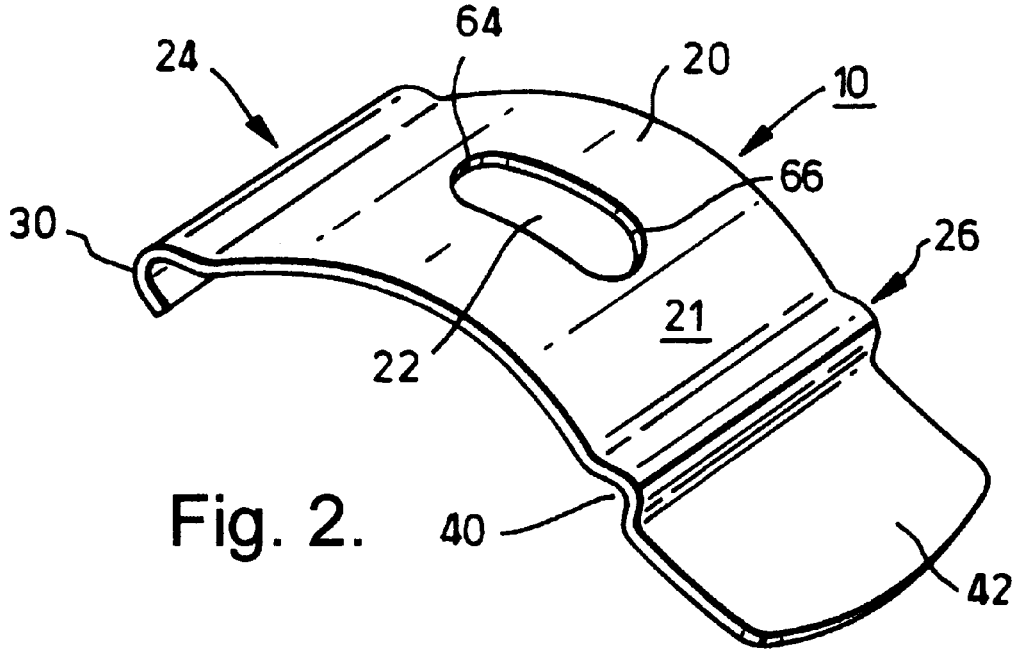
FIG. 2 is an isometric view of a first embodiment of a mounting bracket of this invention.
Figure 3:
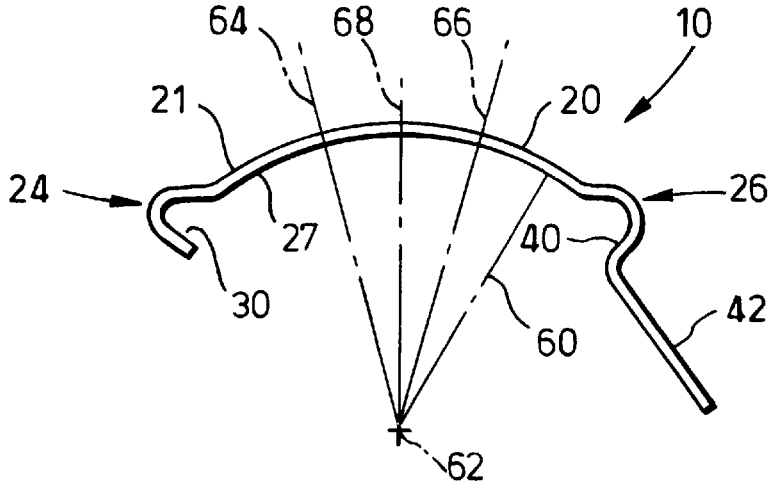
FIG. 3 is a front elevation of the mounting bracket of FIG. 2.
Figure 4:
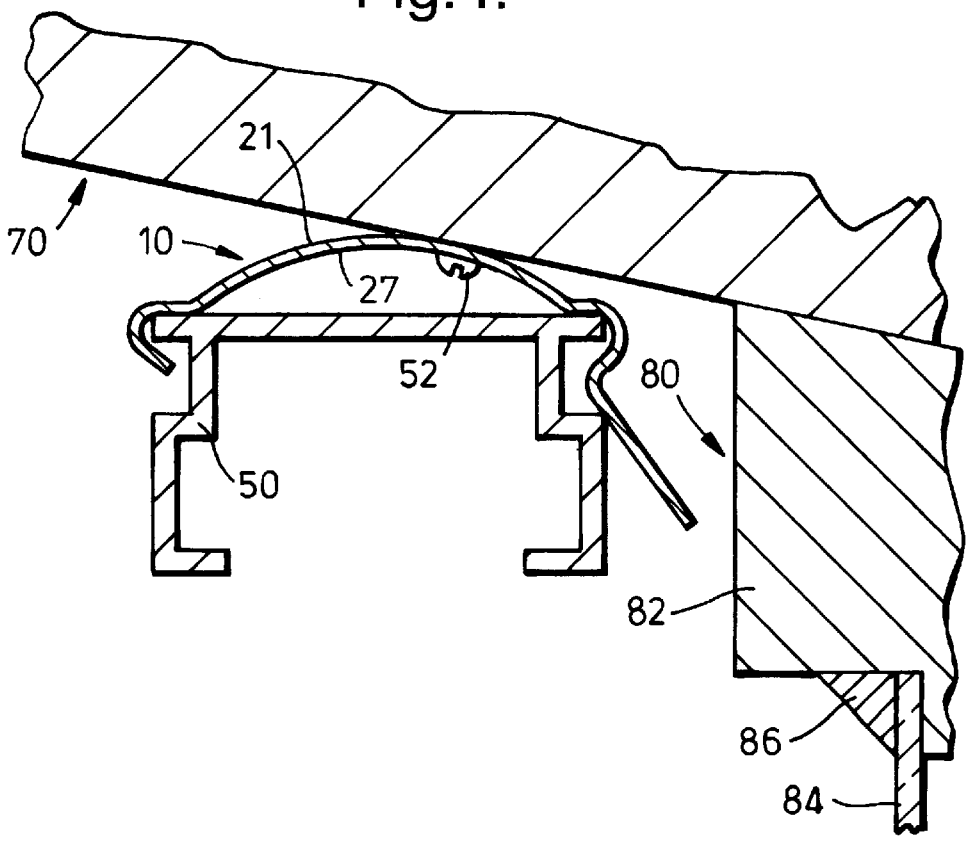
FIG. 4 is a cross-sectional view of a building structure with the mounting bracket of FIGS. 2 and 3 mounted thereon.

FIGS. 2–4 show one embodiment of a mounting bracket 10 in accordance with this invention. Although there are many similarities with the known bracket 10*a,* the main body portion 20 of the mounting bracket 10 in accordance with the invention is formed with a profile that is a convex curve as shown in FIGS. 3 and 4. As a result, the upper surface 21 of the main body portion 20, as shown in FIG. 2, is a convex curved surface. This convex curved surface 21 of the main body portion 20 is intended to be convex relative to the fixation surface 70, to be affixed to the bracket 10 (as shown in FIG. 4), but concave relative to the rail to be fixed to the flanges 30,40 of the main body portion 20 (as also shown in FIG. 4). This convex curved surface 21 of the main body portion 20 is provided with a mounting aperture 22 that is a circumferentially elongate slot, extending through the main body portion transversely of the first and second edges 24,26 on opposite sides of the main body portion 20. Inturned flanges 30 and 40, on the opposite sides of the main body portion 20, enable the bracket 10 to be affixed to a rail of a window covering, with the flanges extending in the lengthwise direction of the rail.

The lower surface 27 of the main body portion 20 is preferably parallel to the upper surface 21 and therefore is also a concave curved surface. However, it is not necessary that the lower surface 27 be parallel to the upper surface 21 or be also a convex curved surface.

When the bracket 10 of this invention has been fixed to a sloping fixation surface (70 in FIG. 4), a desired orientation of a window covering product can be obtained by moving the mounting bracket 10 on a fixation means 52 (in FIG. 4), inserted through the circumferentially elongate, mounting aperture 22, along the convex curved surface 21 of the main body portion 20 and then fixing the bracket 10 and its inturned flanges 30 and 40 at the desired orientation with the fixing means.

As shown in FIG. 3, the bracket 10 and its main body portion 20 are preferably formed of a sheet material, e.g., metal, which is arcuately curved along a radius 60 having a centre point 62, to define the convex curved surface 21 as shown in FIGS. 3 and 4. The circumferentially elongate, mounting aperture 22 has ends 64,66, which are equally spaced from a centre line 68 and determine a maximum angle between the main body portion 20 and a given fixation surface of a building structure. Although the bracket 10 has a smooth convex curve in its main body portion 20, any substantially curved surface will work at least to some extent. For example, the main body portion 20 can have a plurality of rectangular facets arranged perpendicularly to the circumferentially elongate, mounting aperture 22, these collectively defining a convex curved surface. Such an embodiment provides certain predetermined orientations of the mounting bracket and assures most optimal fixation. Clearly the mounting bracket 10 does not need to have a symmetrical shape, nor does the mounting aperture 22 need to have a central location in the main body 20.

FIG. 4 shows a fixation surface 70 of a building structure with the mounting bracket 10 of FIGS. 2 and 3 fixed in place. The bracket 10 holds a rail 50 and is provided with a fixing means, here a screw 52. The rail 50, which can be part of any window covering product, is only schematically shown—without any operating means or shade or blind body. The fixation surface shown, by way of example, is a sloped ceiling 70 with a window arrangement 80, having a frame 82 accommodating a pane 84, and a pane lath 86. The mounting bracket 10 is fixed with the screw 52 through the mounting slot 22 into the ceiling 70, so that a window covering product can be suspended parallel to the pane 84 on the ceiling 70 that is sloped in a direction transverse of the length of the rail of the window covering product.

Alternatively, the main body portion 20 and its circumferentially elongate, mounting aperture 22 can be curved in other directions. For example, their convex curvature can be parallel to, rather than transverse of, the inturned flanges 30 and 40, on the opposite sides of the main body portion 20. This would allow the bracket 10 to be affixed to a fixation surface 70 that is uneven or sloped in the lengthwise, rather than the transverse, direction of the rail of the window covering, to be attached to the inturned flanges 30 and 40 of the bracket 10.

Furthermore, the bracket 10 can be used to affix other parts of a window covering product, such as a bottom rail. In skylight applications, a window covering product may have both a head rail and a bottom rail, which can be both easily affixed with the bracket 10, even to frames having sloping surfaces.

Figure 5:
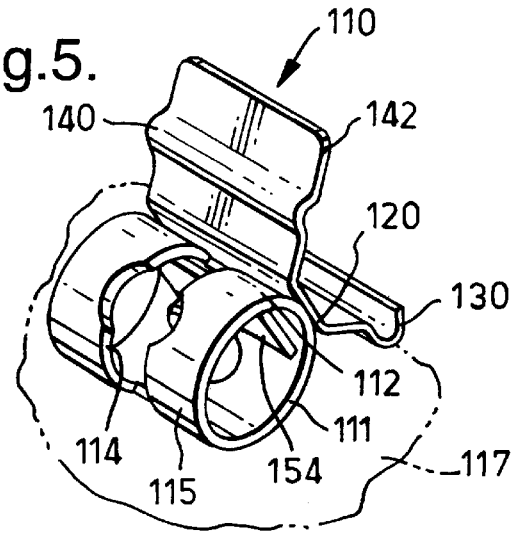
FIG. 5 is an isometric view of a second embodiment of a mounting bracket of this invention.
Figure 6:
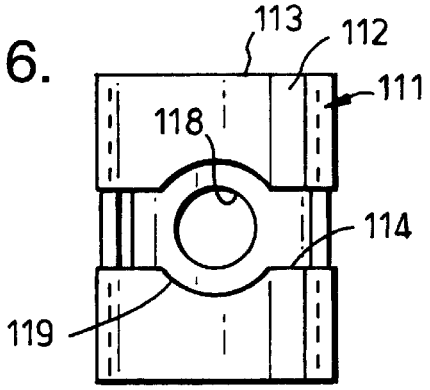
FIG. 6 is a plan view of the tubular support member of the bracket of FIG. 5.
Figure 7:
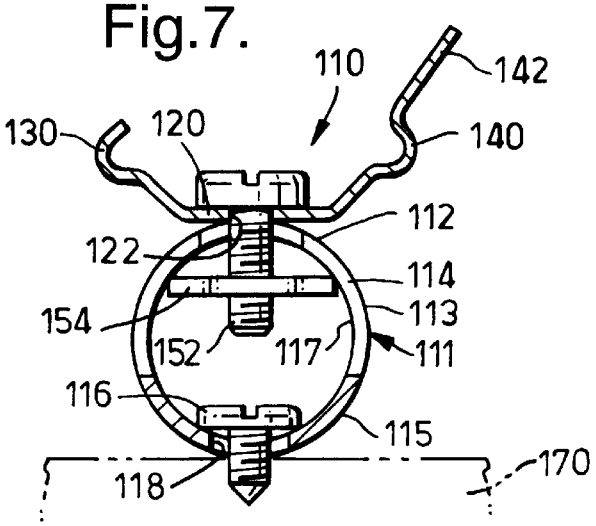
FIG. 7 is a schematic end elevation of the bracket of FIG. 5.

FIGS. 5–7 show an alternative mounting-bracket 110 of this invention comprising an elongate hollow support member 111 and a main body portion 120. The support member 111 preferably is generally tubular and therefore has a profile with a convex curved outer surface 112 on a first circumferential side 113, adjacent to the main body portion 120, as shown in FIG. 7. As shown in FIG. 7, this convex curved surface 112 of the support member 111 is intended to be convex relative to the main body portion 120, to be affixed to the rail (not shown), but concave relative to the fixation surface 170, to be fixed to an opposite second circumferential side 115 of the support member 111. The convex curved surface 112 of the support member 111 has a circumferentially elongate slot 114 extending through it, adjacent to the main body portion 120. The elongate slot 114 can extend circumferentially around the support member 111 for up to about 180°.

The inner surface 117 of the support member 111, on its first circumferential side 113, is preferably parallel to the outer surface 112 and therefore is also a concave curved surface. However, it is not necessary that the inner surface 117 be parallel to the outer surface 112 or be also a convex curved surface.

As best seen in FIG. 7, the second circumferential side 115 of the support member 111 is mounted on a fixation surface 170 of a building structure by means of a conventional mounting screw 116. The mounting screw 116 passes through a first mounting aperture 118 in the second side 115 of the support member 111 and into the fixation surface 170. Preferably, the first and second sides 113 and 115 of the support member 111 are on substantially opposite circumferential sides of the support member 111.

The main body portion 120 of the mounting bracket 110 preferably is generally similar to the main body portion 20*a* of the known bracket 10*a* of FIG. 1 but can also be like the main body portion 20 of the bracket 10 of FIGS. 2–4. A second mounting aperture 122, which can be circular or elongate, extends through the main body portion 120. Inturned flanges 130 and 140, on opposite sides of the main body portion 120, extend in a direction transverse to the elongate slot 114 in the support member 111. The inturned flanges 130 and 140 are adapted to be affixed to a rail of a window covering in the lengthwise direction of the rail, so that the rail extends in a direction transverse of the slope of the fixation surface 170.

Passing through the second mounting aperture 122 and through the elongate slot 114 of the support member 111, on its first circumferential side 113, is a conventional fixing bolt 152, threaded into a nut 154 within the support member. The nut 154 has a female screw thread cooperating with the thread of the bolt 152. The nut 154 preferably has a rectangular shape or at least a pair of flats on opposite sides and is dimensioned to fit closely within the support member 111, as shown in FIG. 7, so that the nut 154 will not rotate when the bolt 152 is threaded through it.

By loosening the fixing bolt 152 relative to the nut 154, the position of the bracket 110 can be adjusted along the circumferential convex outer surface 112 of the support member 111 by adjusting the position of the bolt 152 within the elongate slot 114. The bolt 152 can thereafter be tightened again in any adjusted position to secure the main body portion 120 to the support member 111 and thereby to the fixation surface 170 at a desired relative angular orientation.

Aligned with the first mounting aperture 118, for the passage of the mounting screw 116, is an enlarged area 119 in the slot 114 as seen in FIGS. 5–7. A screw driver can readily access the mounting screw 116 in the first mounting aperture 118, through the enlarged area 119 in the slot 114, to affix the support member 120 of the bracket 110 to a fixation surface 170 of a building structure.

As with the first embodiment of the bracket 10, the outer surface of the support member 111 of the bracket 110 can also have a plurality of rectangular facets collectively defining the convex curved outer surface 112 on its first circumferential side 113. Likewise, the main body portion 120 can also have its inturned flanges 130 and 140 extend in the direction of the elongate slot 114 in the support member 111. This would allow the bracket 110 and the rail of a window covering, mounted on the bracket, to be affixed to a fixation surface 170 that is uneven or sloped in the lengthwise, rather than the transverse, direction of the rail.

This invention is, of course, not limited to the above-described embodiments which may be modified without departing from the scope of the invention or sacrificing all of its advantages. In this regard, the terms in the foregoing description, such as "convex", "concave", "upper", "lower", "bottom", "top", "inner", "outer" and "end", have been used only as relative terms to describe the relationships of the various elements of the mounting bracket of the invention.

I claim:

1. A mounting bracket for mounting a rail of a window covering product to a fixation surface, the mounting bracket comprising (a) a main body portion;

(b) opposed edges on said main body portion, each of said opposed edges including a flange adapted to releasably lock into engagement with the rail of the window covering product;

(c) a mounting aperture in said main body portion;

(d) fixing means extending through said mounting aperture effective to fix the mounting bracket to the fixation surface; and (e) a convex curved surface formed on said main body portion, said mounting aperture being a circumferentially elongate slot located in said convex curved surface, whereby said main body portion and the rail supported thereby may be adjusted in position and at an angle determined by a position of said fixing means relative to said convex curved surface.

2. The mounting bracket of claim 1 wherein said elongate slot extends transversely of said opposite edges of said main body portion.

3. The mounting bracket of claim 1 wherein said main body portion is formed of arcuately curved sheet material whereby one face of said main body portion includes said convex curved surface.

4. The mounting bracket of claim 1 wherein said main body portion is made of a resilient material and one edge of said main body portion is provided with an outwardly extending release member, enabling said main body portion to be flexed to disengage said one edge from the rail of the window covering product.

5. A mounting bracket for mounting a rail of a window covering product to a fixation surface, the mounting bracket comprising (a) a main body portion;

(b) opposed edges of said main body portion engageable with the rail;

(c) a first mounting aperture in said main body portion; and (d) fixing means engaged in said mounting aperture effective to fix the mounting bracket to the fixation surface, wherein said fixing means comprises (i) an elongate hollow support member having an outer surface on one circumferential side that forms a convex curved surface and that includes an elongate slot, wherein said elongate slot is located adjacent to said first mounting aperture of said main body portion;

(ii) first mounting means, on a substantially opposite circumferential side of said support member from said one circumferential side, to affix said support member to the fixation surface, so that said convex curved surface is concave relative to the fixation surface; and (iii) second mounting means, passing through said first mounting aperture in said main body portion and through said elongate slot in said support member, to affix said main body portion to said support member, whereby said main body portion and the rail supported thereby may be adjusted in position and at an angle determined by the position of said main body portion relative to said convex curved surface.

6. The mounting bracket of claim 5 wherein said elongate slot of said support member extends transversely of said opposite edges of said main body portion.

7. The mounting bracket of claim 5 wherein said support member is tubular, and said first mounting means comprises a second mounting aperture for the passage of a mounting screw through said substantially opposite circumferential side of said support member to engage the fixation surface.

8. The mounting bracket of claim 7 wherein said elongate slot in said support member is enlarged, opposite said second mounting aperture, so that a screw driver can readily access said mounting screw in said second mounting aperture.

9. The mounting bracket of claim 5 wherein said second mounting means comprises a bolt passing through said first mounting aperture in said main body portion, through said elongate slot in said support member and engaging a nut located within said support member.

10. The mounting bracket of claim 5 wherein said main body portion is made of a resilient material and one edge of said main body portion is provided with an outwardly extending release member, enabling said main body portion to be flexed to disengage said one edge from the rail of the window covering product.

11. A bracket for mounting a rail of a window covering product to a building surface, the bracket including:

(i) a main body portion, having a mounting aperture therein;

(ii) opposite edges on said main body portion, each of said opposite edges including an inturned flange adapted to engage the rail of the window covering product; and (iii) fixing means engaged in said mounting aperture and adapted to affix the bracket to the building surface;

wherein said fixing means is associated with a convex curved surface and an elongate slot formed in said convex curved surface to extend in a direction of convex curvature of said convex curved surface thereby enabling said main body portion to be adjustably positioned at an angle determined by a relative position of said fixing means and said elongate slot.

12. The bracket of claim 11 wherein said convex curved surface is on said main body portion; said mounting aperture being formed by said elongate slot; and said fixing means extends through said elongate slot for directly engaging the building surface.

13. The bracket of claim 12 wherein said elongate slot extends transversely of said opposite edges of said main body portion.

14. The bracket of claim 12 or 13 wherein said main body portion is formed of arcuately curved sheet material whereby one face of said main body portion includes said convex curved surface.

15. The bracket of claim 11 wherein said fixing means includes:

(i) a generally tubular support member having said convex curved surface included on an outer circumferential portion of said support member with the elongate slot being formed in said convex curved surface on said support member;

(ii) mounting means on a circumferential side substantially opposite to said convex curved surface to affix said support member on the building surface; and wherein said fixing means further comprises a bolt passing through said mounting aperture and said elongate slot engaging a nut located within said support member to affix said main body portion to said support member.

16. The bracket of claim 15 wherein said support member has its elongate slot extending transversely of said opposite edges of said main body portion.

17. The bracket of claim 15 wherein said mounting means includes a hole for allowing passage of a mounting screw to engage the building surface.

18. The bracket of claim 17 wherein said elongate slot in said support member is provided with an enlargement, opposite said hole, so that a screw driver can readily obtain access to the mounting screw in said hole.

19. The bracket of claim 11 wherein said main body portion is made of a resilient material and one of said opposite edges is provided with an outwardly extending flexible release member, enabling said main body portion to be flexed for disengagement of said one edge from the rail of the window covering product.

20. The bracket of claim 11 wherein said convex curved surface is composed as a plurality of rectangular facets arranged perpendicular to the said elongated slot, said rectangular facets collectively forming said convex curved surface.

* * * * *